US006367795B1

(12) United States Patent
Matsuda et al.

(10) Patent No.: US 6,367,795 B1
(45) Date of Patent: Apr. 9, 2002

(54) PAPER FEED APPARATUS

(75) Inventors: Yasuhiro Matsuda; Yoshiki Tsuchiyama, both of Kanazawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 09/546,176

(22) Filed: Apr. 10, 2000

(30) Foreign Application Priority Data

Apr. 9, 1999 (JP) ..... 11-102002

(51) Int. Cl.[7] ..... B65H 1/08

(52) U.S. Cl. ..... 271/126; 271/121; 271/137; 271/138

(58) Field of Search ..... 271/121, 126, 271/137, 138

(56) References Cited

U.S. PATENT DOCUMENTS 3,948,506 A * 4/1976 Crimmins et al. ..... 271/165
4,305,577 A * 12/1981 Clay et al. ..... 271/119
4,474,365 A * 10/1984 DiBlasio ..... 271/3
4,852,868 A * 8/1989 Fukui et al. ..... 271/122
5,154,408 A * 10/1992 Stepan et al. ..... 271/121
5,228,677 A * 7/1993 Asakawa ..... 271/126
5,370,381 A * 12/1994 Winship et al. ..... 271/121
5,453,852 A * 9/1995 Morikawa et al. ..... 358/498
5,655,762 A * 8/1997 Yergenson ..... 271/121
6,000,689 A * 12/1999 Furuki et al. ..... 271/10.11

* cited by examiner

*Primary Examiner*—Christopher P. Ellis
*Assistant Examiner*—Jeffrey A. Shapiro

(57) ABSTRACT

The picking roller successively picks a plurality of sheets of paper stacked on the shooter from the bottom of the paper stack. The gate extends substantially perpendicular to a paper transport direction and forms a predetermined clearance between the picking roller. The separation pad is disposed in sliding contact with the outer circumferential surface of the picking roller and adapted to draw inside a single sheet of paper. The picking arm is driven to move to an upper position when sheets of paper are placed on the shooter, and to a lower position when the sheets of paper are fed in order to press the sheets of paper placed on the shooter toward the outer circumferential surface of the picking roller. The paper guide is disposed above the picking roller and has an opening and a bridge portion. The bridge portion extends across the opening and is fitted in a circumferential groove formed in an axially center portion of the picking roller.

16 Claims, 12 Drawing Sheets

PAPER FEED APPARATUS

BACKGROUND OF THE INVENTION

1. Field of the Invention

The present invention relates to a paper feed apparatus, and more particularly to a bottom-drawing-type paper feed apparatus which is suitable for, for example, an image scanner and which has an improved sheet separation performance, eliminates necessity of a pre-operation before setting of sheets of paper to thereby facilitate operation, and prevents occurrence of a paper jam and/or upturn of a leading end of a sheet.

2. Description of the Related Art

In general, an image scanner is provided with an automatic paper feed apparatus which enables the image scanner to automatically transport and read a huge amount of documents. Such an automatic paper feed apparatus comprises a picking mechanism for transporting a plurality of sheets of paper stacked on a shooter to a predetermined standby position; a separation mechanism for drawing inside a sheet of paper at a time from the standby position; a feed mechanism for feeding the separated sheet; and a discharge mechanism for discharging the sheet to a stacker or the outside of the scanner after the sheet has been scanned. Recently, such an automatic paper feed apparatus has been controlled by means of a microprocessor.

FIG. 13 is an explanatory view showing a main portion of a conventional paper feed apparatus. As shown in FIG. 13, a picking roller 72 and a separation roller 73 are drivingly linked via a gear 83 so that the picking roller 72 and the separation roller 73 rotate in the same direction; and the separation roller 73 is drivingly linked to a feed roller 74 via a gear 79. Further, a pressing arm 81 is disposed in sliding contact with the picking roller 72, and a separation pad 80 is disposed in sliding contact with the separation roller 73. Moreover, a gate 84 is disposed on a paper feed path between the picking roller 72 and the separation roller 73.

The pressing arm 81 is provided in order to enable reliable transport of sheets of paper set on a shooter 71 and is formed from a spring member. One end of the pressing arm 81 is fixed to an unillustrated frame, and the other end of the pressing arm 81 is biased toward the picking roller 72 to thereby come into contact with the top sheet of paper while applying a certain pressing force to the sheets of paper. By means of frictional force which is generated between the picking roller 72 and the sheets of paper due to the pressing force, the sheets of paper are transported from the shooter 71 to the separation roller 73.

The gate 84 is provided so as to secure a clearance in the thickness direction of sheets on the paper feed path in order to enable passage of a few sheets of paper, thereby enabling reliable transport of the sheets. The gate 84 has a paper-abutting surface which forms an acute angle with respect to the paper transport direction along the paper feed path.

A one-way clutch is attached to each of the picking roller 72, the separation roller 73, and the discharge roller 75 such that the separation roller 73 rotates in the counterclockwise direction in FIG. 13, and the discharge roller 75 rotates in the clockwise direction (paper transport direction) only. Further, a sensor 82 for detecting the leading end of each sheet of paper is disposed along the paper feed path in the vicinity of and on the downstream side of the separation roller 73. Further, a sensor 85 for detecting the leading and trailing ends of each sheet of paper is disposed along the paper feed path in the vicinity of and on the downstream side of the feed roller 74.

In the above-described automatic paper feed apparatus, when a pulley 76 connected to an unillustrated motor is rotated in the counterclockwise direction, a belt 77 engaged with the pulley 76 causes the feed roller 74 to rotate in the counterclockwise direction, or in a direction opposite the paper transport direction. At this time, the discharge roller 75 does not rotate even when the belt 77 moves. Meanwhile, the picking roller 72 and the separation roller 73 are rotated in the counterclockwise direction (paper transport direction) via gears 79 and 83. Therefore, a single sheet of paper is drawn inside from the unillustrated paper stack on the shooter 71 by the picking roller 72 and is transported toward the separation roller 73. If a plurality of sheets of paper are picked erroneously, the gate 84 and the separation pad 80 prevent transfer of the plurality of sheets, so that only a single sheet of paper in close contact with the picking roller 72 and the separation roller 73 is transported toward the feed roller 74. Therefore, transportation of two sheets (double feed or a like) problem does not occur.

Even when the leading end of the transported sheet of paper reaches the feed roller 74, the sheet of paper is not supplied to the feed roller 74 instantaneously but is stopped there for a short period of time, because the feed roller 74 is rotating in the counterclockwise direction, which is opposite the paper transport direction. During this period, positioning of the leading end of the sheet is performed. The stop time is controlled on the basis of a predetermined number of pulses or a predetermined period of time after the sensor 82 detects the leading end of a sheet of paper. After elapse of the predetermined period of time, the unillustrated motor rotates in the reverse direction in order to rotate the pulley 76 in the clockwise direction. Therefore, the feed roller 74 and the discharge roller 75 are also rotated in the clockwise direction via the belt 77. As a result, the sheet of paper is transported by the feed roller 74 to a reading mechanism 78. Immediately before the leading end of the sheet of paper reaches the reading mechanism 78, the leading end is detected by the sensor 85. In response to a detection signal generated by the sensor 85, the read operation is started. When the sensor 85 detects the trailing end of the sheet of paper, the read operation is ended, and the discharge roller 75 is operated to discharge the sheet of paper onto an unillustrated stacker.

In the above-described automatic paper feed apparatus, when, as shown in FIG. 14A, a large number of sheets of paper 90 are placed onto the shooter 71, the sheets of paper 90 must be aligned in a staggered manner beforehand such that the leading ends of the sheets of paper 90 form a knife-edge-like shape 91, as shown in FIG. 14B, in order to make it easy to feeding the sheets of paper to the separation roller 73.

The above-described conventional paper feed apparatus has the following drawbacks.

Since the gate—which forms a clearance in the thickness direction of sheets of paper on the paper feed path—extends at an acute angle with respect to the paper transport direction, a vertical component force is generated and is applied to the sheets of paper, resulting in an impairment in paper separation performance.

Further, when a large number of sheets of paper are placed onto the shooter, the sheets of paper must be aligned in a staggered manner beforehand such that the leading ends of the sheets of paper form a knife-edge-like shape. However, this pre-operation is considerably cumbersome, and is sometimes neglected or forgotten. In this case, sheets of paper cannot be supplied smoothly.

Moreover, the separation roller is disposed between the picking roller and the feed roller; the pressing arm is disposed in sliding contact with the picking roller; and the separation pad is disposed in sliding contact with the separation roller. Therefore, the transport mechanism portion of the paper feed apparatus has a relatively large size.

Further, since the picking roller is disposed such that a portion of the outer circumference of the picking roller is exposed to the outside from an opening provided in a paper guide, when the picking roller picks and transfers a sheet of paper, the sheet may be caught between the picking roller and the paper guide, resulting in occurrence of a paper jam and stoppage of paper feed.

Moreover, although the separation pad is disposed to prevent so-called double feed in which a plurality of sheets of paper are supplied, the disposition of the separation pad causes an undesirable phenomenon such that the leading end of a sheet engages the separation pad and is turned up.

SUMMARY OF THE INVENTION

In view of the foregoing problems involved in conventional techniques, it is an object of the present invention to provide a paper feed apparatus which has an improved sheet separation performance, facilitates operation, and prevents occurrence of paper jam of a leading end of a sheet.

It is an another object of the present invention to provide a paper feed apparatus which has an improved sheet separation performance, facilitates operation, and prevents occurrence of upturn of a leading end of a sheet.

In order to achieve the above-described object, the present invention provides a paper feed apparatus comprising: a picking roller successively picking a plurality of sheets of paper stacked on the shooter from the bottom of the paper stack, transporting the sheets of paper to a standby position and having one or a plurality of circumferential grooves formed on it; a gate extending substantially perpendicular to a paper transport direction and forming a predetermined clearance between the gate and the picking roller; a separation pad disposed in sliding contact with the outer circumferential surface of the picking roller and adapted to draw inside a single sheet of paper at a time from the standby station; a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening; and a paper guide disposed above the picking roller and having an opening and a bridge portion extending across the opening and fitted in a circumferential groove formed in an axially center portion of the picking roller.

The present invention also provides a paper feed apparatus comprising: a picking roller successively picking a plurality of sheets of paper stacked on the shooter from the bottom of the paper stack and transporting the sheets of paper to a standby position; a gate extending substantially perpendicular to a paper transport direction and forming a predetermined clearance between the gate and the picking roller; a separation pad disposed in sliding contact with the outer circumferential surface of the picking roller and adapted to draw inside a single sheet of paper at a time from the standby station; a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening; a pressing arm formed of an elastic material and disposed in sliding contact with the picking roller; and guide arms disposed on the upstream side of the pressing arm with respect to the paper transport direction such that their tip ends are located in proximity to the picking roller.

The present invention further provides a paper feed apparatus comprising: a picking roller successively picking a plurality of sheets of paper stacked on the shooter from the bottom of the paper stack and transporting the sheets of paper to a standby position; a gate extending substantially perpendicular to a paper transport direction and forming a predetermined clearance between the gate and the picking roller; a separation pad disposed in sliding contact with the outer circumferential surface of the picking roller and adapted to draw inside a single. sheet of paper at a time from the standby station; a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening; and a guide sheet formed of a material having a coefficient of friction lower than that of the material constituting the separation pad, the guide sheet being disposed to cover a portion of the separation pad such that the guide sheet does not contact the picking roller, and such that the leading end of the sheet of paper can abut and slide along the guide sheet.

The present invention further provides a paper feed apparatus comprising: a picking roller successively picking a plurality of sheets of paper stacked on the shooter from the bottom of the paper stack and transporting the sheets of paper to a standby position; a gate extending substantially perpendicular to a paper transport direction and forming a predetermined clearance between the gate and the picking roller; a separation pad disposed in sliding contact with the outer circumferential surface of the picking roller and adapted to draw inside a single sheet of paper at a time from the standby station; a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening; and a guide member disposed between the gate and the separation pad with respect to the paper transport direction, a surface of the guide member having an inclination angle with respect to the paper transport direction smaller than that of a surface of the separation pad, and the guide member being provided integrally with the gate or a holding member supporting the separation pad such that the guide member does not contact the picking roller and such that the leading end of the sheet of paper can abut and slide along the guide member.

BRIEF DESCRIPTION OF THE DRAWINGS

FIGS. 1 and 2 are views showing an image scanner according to an embodiment of the present invention, wherein FIG. 1 is a perspective view of the image scanner, and FIG. 2 is a sectional view of the image scanner;

FIGS. 7 and 8 are views showing an integrally-molded gate component used in the embodiment of the present invention, wherein FIG. 7 is a perspective view of the gate component, and FIG. 8 is an exploded perspective view of the gate component;

FIGS. 14A and 14B are side views of a large number of stacked sheets of paper, wherein FIG. 14A shows a state before an operation of aligning the sheets in a staggered manner, and FIG. 14B shows a state after that the alignment operation.

DESCRIPTION OF THE PREFERRED EMBODIMENTS

Embodiments of the present invention will now be described.

Figure 1:
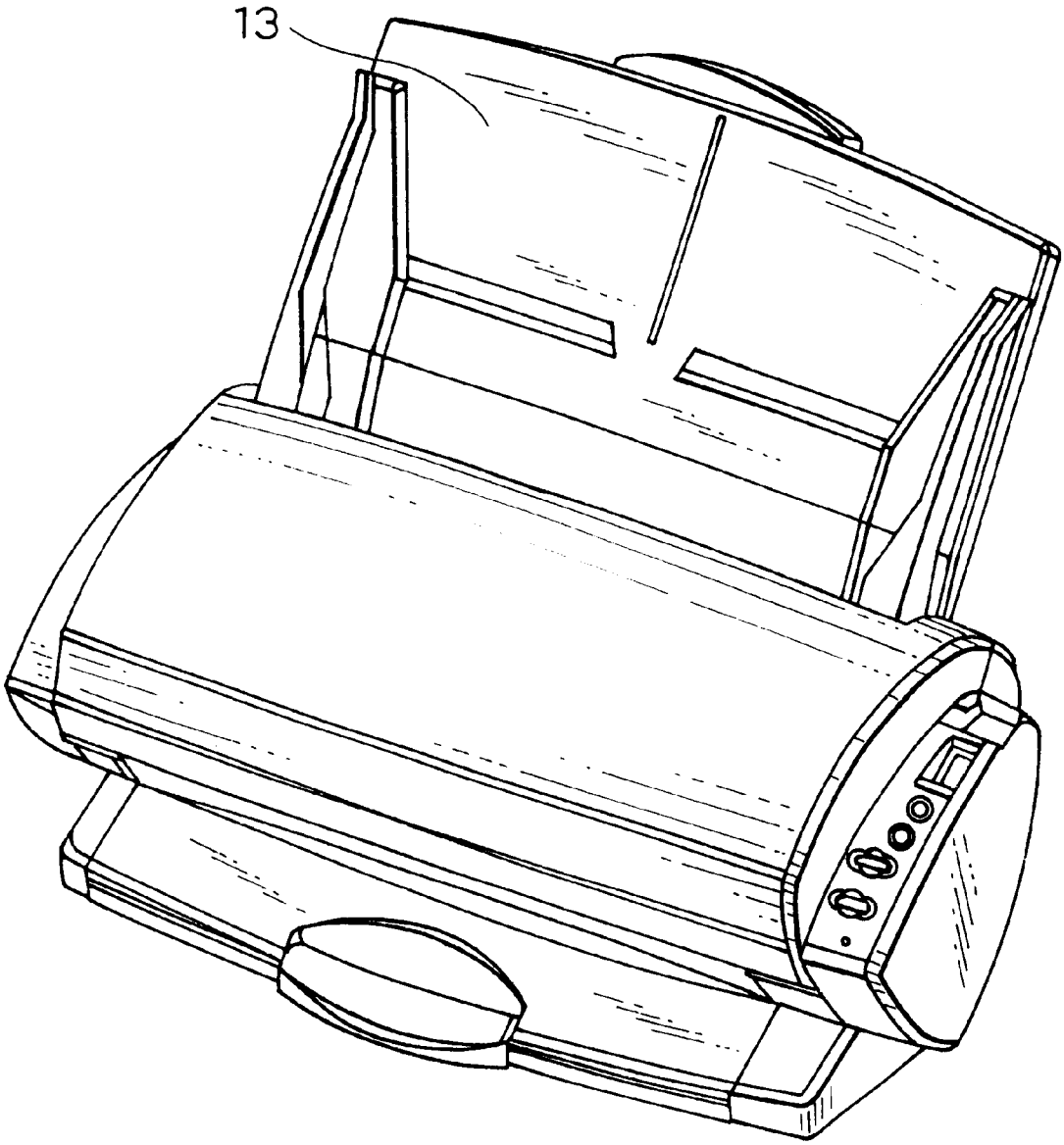
Figure 2:
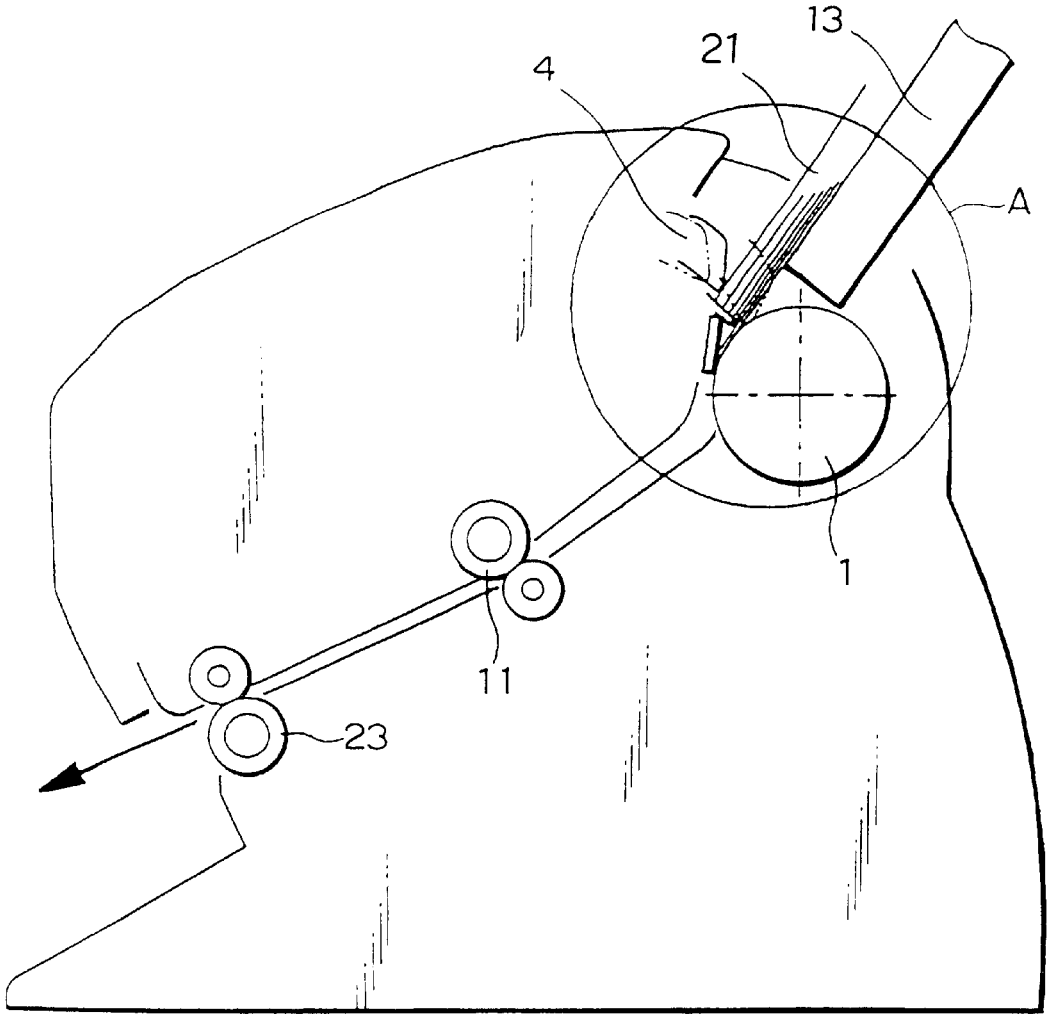

FIGS. 1 and 2 are a schematic perspective view and a sectional view, respectively, of an image scanner according to an embodiment of the present invention. As shown in FIGS. 1 and 2, the image scanner has at its rear end a shooter 13 on which documents to be scanned are placed, as well as a paper feed apparatus disposed inside the scanner. The paper feed apparatus has a picking mechanism disposed in the vicinity of a paper supply opening of the shooter 13. The picking mechanism comprises a picking roller 1 and a picking arm 4. The picking roller 1 and picking arm 4 cooperate to successively pick a plurality of sheets of paper 21 (original documents of paper or any other medium carrying characters, figures, symbols, etc.) stacked on the shooter 13, one sheet at a time, from the bottom of the paper stack. Subsequently, the picking roller 1 transfers a sheet of paper to a predetermined standby position. In FIG. 2, the direction of transport of the sheets of paper 21 is indicated by an arrow.

Figure 3:
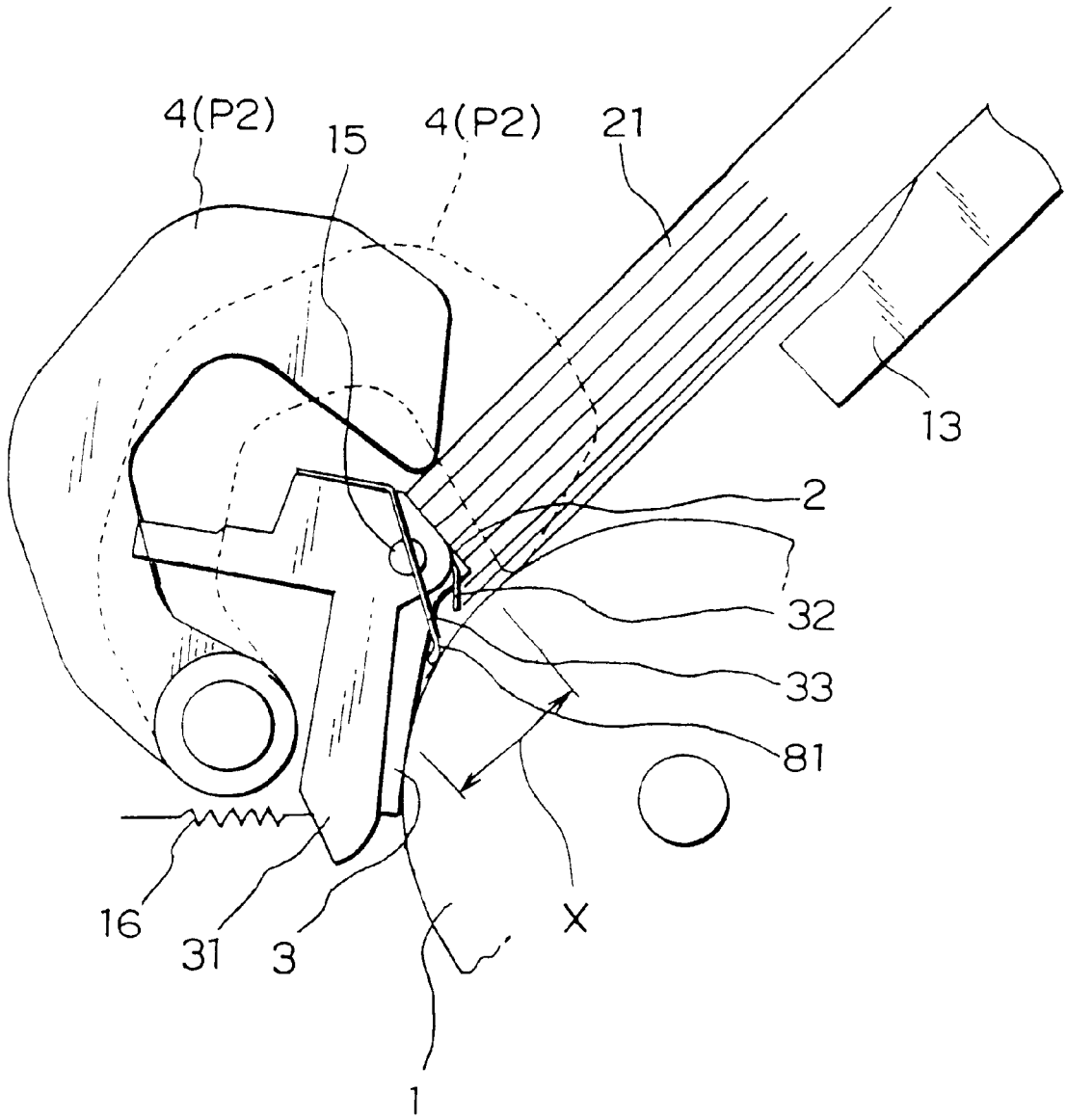
FIG. 3 is an enlarged view of a portion A shown in FIG. 2.

FIG. 3 is an enlarged view of a region A in FIG. 2, showing in detail the embodiment of the present invention. As shown in FIG. 3, the picking roller 1 is disposed on the lower side and in the vicinity of the paper supply opening of the shooter 13. On the upper side of the picking roller 1, the picking arm 4, a gate 2, a paper separation pad 3 are disposed along the paper supply path, in this sequence. Reference numeral 31 denotes a holding member which holds the paper separation pad 3 and presses it against the outer circumferential surface of the picking roller 1. Reference numeral 33 denotes a guide sheet provided to cover a portion of the paper separation pad 3. Reference numeral 32 denotes guide arms, which are disposed on the upstream side of pressing arms 81 with respect to the paper entrance direction (i.e., the paper transport direction) such that the distal ends of the guide arms 32 are located in proximity to the picking roller 1. The holding member 31, the guide sheet 33, and the guide arms 32 will be described later.

The picking roller 1 is formed of a material having a large friction coefficient, such as foam rubber. The gate 2, in cooperation with the picking roller 1, forms a clearance (e.g., of a size of about 1 mm) through which a few sheets of paper 21 can pass. The gate 2 extends perpendicular to the entrance direction (i.e., the paper transport direction). The picking roller 1 is disposed so as not to change the transport direction of the sheet(s) of paper 21 during transport. That is, the picking roller 1 is disposed substantially perpendicular to the transport direction. The paper separation pad 3 in sliding contact with the picking roller 1 draws inside, a single sheet at a time, the sheets of paper 21 transported to the standby position. Therefore, the sheets of paper 21 are considered to reach the standby position when the leading edge of the sheets of paper 21 reaches a position at which the paper separation pad 3 is in contact with the picking roller 1 (see FIGS. 10 and 11).

The picking arm 4 is driven such that its distal end moves vertically. When the sheets of paper 21 are to be placed on the shooter 13, the picking arm 4 is moved to and held at an upper position or wait position P1 (see FIG. 5). When the sheets of paper 21 placed on the shooter 13 are to be fed, the picking arm 4 is moved to and held at a lower position or paper feed position P2 (see FIG. 5 as well). When the picking arm 4 is held at the paper feed position, due to a pressing force applied from an unillustrated pressure-applying element to the picking arm 4, the picking arm 4 presses from above the sheets of paper 21 stacked on the shooter 13 in an area in the vicinity of the paper supply opening. Accordingly, as indicated by a solid line and a broken line in FIG. 3, the paper feed position P2 of the picking arm 4 changes depending on the number of sheets of paper 21 (or the total thickness of stacked sheets of paper). As shown in FIG. 3, the paper supply opening may be considered to be the clearance between the picking roller 1 and the gate 2 or a portion at which the sheets of paper 21 come into contact with the guide arms 32.

Figure 14A:
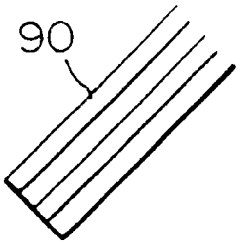
Figure 14B:
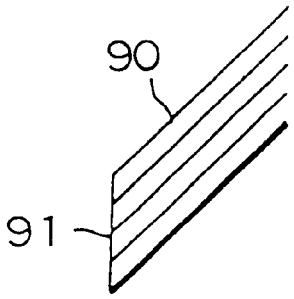

In the structure shown in FIG. 3, since the gate 2 extends perpendicular to the paper transport direction, no component force is generated in the direction perpendicular to the paper transport direction, so that the multi-feed phenomenon (transportation of a plurality of sheets) does not occur, thus improving the paper separation performance. Further, satisfactory picking performance is secured; even when a large number of sheets of paper 21 are placed on the shooter 13, as shown in FIG. 14A, the sheets of paper 21 can be placed as they are without being staggered.

Figure 4:
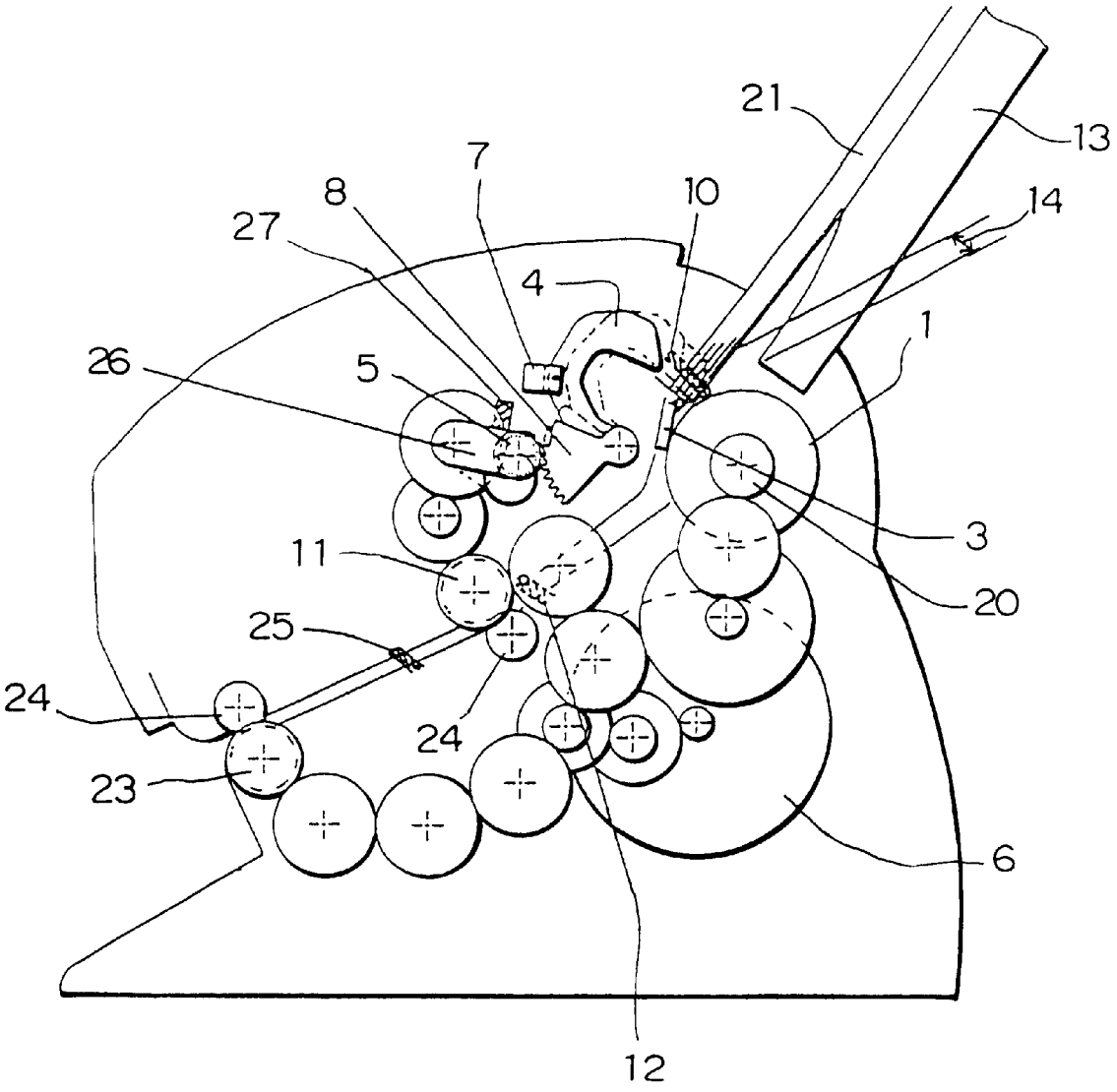
FIGS. 4 and 5 are sectional views showing a drive system for paper transport and picking arm drive in the embodiment of the present invention.
Figure 5:
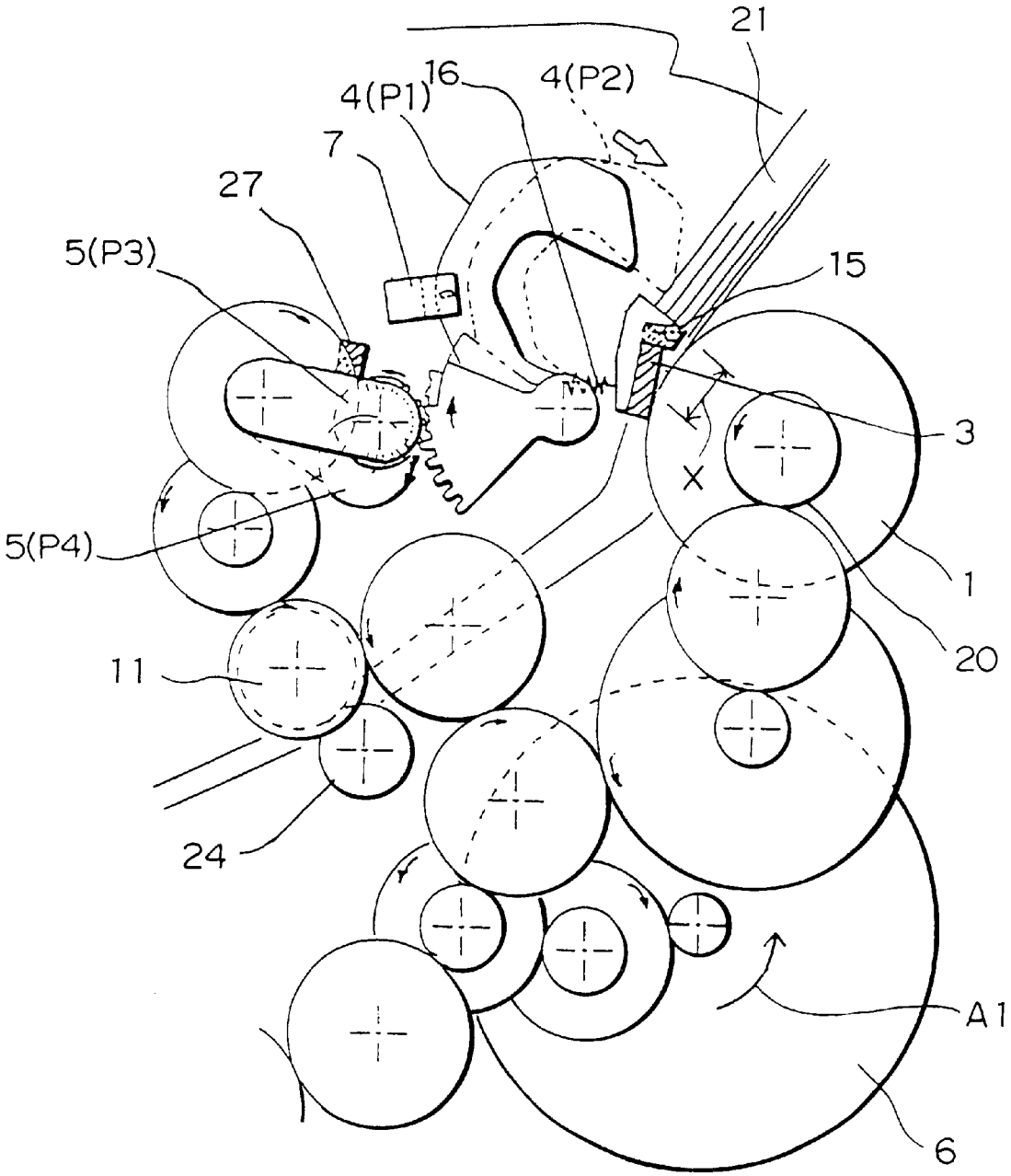

FIGS. 4 and 5 are views showing a drive system for paper transport and picking-arm drive in the embodiment of the present invention. In FIGS. 4 and 5, reference numeral 6 denotes a motor for paper transport whose output shaft rotates in the forward direction indicated by arrow A. Via the gear train shown in FIGS. 4 and 5, the motor 6 drives the picking roller 1, the feed roller 11, and the feed roller 23 to thereby transport the sheets of paper 21. A picking-roller drive gear 20 for driving the picking roller 1 is equipped with a one-way clutch, so that the picking-roller drive gear 20 rotates only in the counterclockwise direction (paper transport direction) in FIGS. 4 and 5. In FIGS. 4 and 5, the feed rollers 11 and 23 are shown by use of broken lines. Reference numeral 24 denotes follower rollers disposed to face the feed rollers 11 and 23, respectively.

Reference numeral 8 denotes a picking-arm drive gear which has a pivot and is connected to the picking arm 4. Reference numeral 5 denotes a planetary gear which is rotatably coupled to a planetary gear frame 26 and is in meshing engagement with the picking-arm drive gear 8. Rotation of the feed roller 11 is transmitted to the planetary gear 5 via a gear train shown in FIGS. 4 and 5 to thereby drive the planetary gear 5. Reference numeral 27 denotes a planetary-gear frame stopper for restricting the pivoting range of the planetary gear frame 26.

When the picking arm 4 is to be moved to and maintained at the lower position or paper feed position P2, the motor 6 is driven to rotate forward, so that the planetary gear 5 is disengaged from the picking arm drive gear 8. As a result, the picking arm 4 is positioned at the lower position. When the picking arm 4 is to be moved to and maintained at the upper position or wait position P1, the motor 6 is driven to rotate in reverse, so that the planetary gear 5 comes into meshing engagement with the picking arm drive gear 8 in order to move the picking arm 4 to the upper position. The details of the drive-source switchover mechanism using the planetary gear 5 will be described later.

Reference numeral 7 denotes a picking-arm state detection sensor for detecting the picking arm 4 which is moved to the upper position as a result of reverse rotation of the motor 6 and meshing engagement of the planetary gear 5 with the picking-arm drive gear 8. By use of the picking-arm state detection sensor 7, the motor 6 is driven to rotate in the reverse direction until the picking-arm state detection sensor 7 outputs a signal (ON signal) indicating detection of the picking arm 4, so that the picking arm 4 is to be moved to the upper position.

In FIG. 4, reference numeral 10 denotes a paper detection sensor disposed in the vicinity of the shooter 13. The paper detection sensor 10 is disposed at a position such that the paper detection sensor 10 maintains an OFF state when sheets of paper 21 are placed on the shooter 13 in a state in which the picking arm 4 is located at the lower position, but comes into an ON state when the sheets of paper 21 are placed on the shooter 13 in a state in which the picking arm 4 is located at the upper position. By use of the paper detection sensor 10, during initialization or reset operation, the picking arm 4 is moved to the upper position when the paper detection sensor 10 does not output a signal indicating detection of the presence of sheets of paper, but the picking arm 4 is not moved to the upper position when the paper detection sensor 10 outputs the signal indicating detection of the presence of sheets.

Reference numeral 12 denotes a paper detection sensor disposed between the picking roller 1 and the feed roller 11 and adapted to detect presence/absence of a sheet of paper 21 between the picking roller 1 and the feed roller 11. By use of the paper detection sensor 12, when the paper detection sensor 12 outputs signal indicating absence of a sheet of paper or when a sheet of paper is not picked, forward and reverse rotations of the motor 6 are repeated in order to move the distal end of the picking arm 4 vertically, so that the picking arm 4 hits the sheets of paper 21 stacked on the shooter 13.

Reference numeral 25 denotes a paper-end detection sensor for detecting the leading and trailing ends of a sheet of paper 21. When the paper-end detection sensor 25 detects the leading end of the sheet of paper 21, the paper-end detection sensor 25 outputs a signal, in response to which a scanning operation is started. When the paper-end detection sensor 25 detects the trailing end of the sheet of paper 21, the scanning operation is stopped, and the feed roller 23 discharges the sheet of paper 21 to an unillustrated stacker or to the outside of the apparatus.

The height of the shooter 13 is reduced in the vicinity of the paper supply opening in order to form a surface inclined with respect to the paper transport direction and forming a step 14.

Next, the drive source switchover mechanism using the planetary gear 5 will be described with reference to FIG. 5.

When the picking arm 4 is to be moved to and maintained at the lower position or paper feed position, the motor 6 is driven to rotate forward. At this time, the picking roller 1 is rotated in the counterclockwise direction (paper transport direction) via a gear train. Further, the feed roller 11 is rotated in the clockwise direction (paper transport direction) via another gear train. Rotation of the feed roller 11 is transmitted via another gear train to the planetary gear 5 located at a wait position P3, so that the planetary gear 5 rotates counterclockwise about its own axis, and starts a clockwise revolving motion while maintaining meshing engagement with the picking-arm drive gear 8. Subsequently, having started the revolving motion, the planetary gear 5 disengages from the picking-arm drive gear 8 and moves to a paper feed position P4. At this time, the picking arm 4 connected to the picking-arm drive gear 8 is moved downward by means of pressing force applied from a pressure applying element. Consequently, the picking arm 4 presses from above the sheets of paper 21 stacked on the shooter 13 in an area in the vicinity of the paper supply opening.

When the picking arm 4 is to be moved to and maintained at the upper position or wait position, the motor 6 is driven to rotate in reverse. At this time, the feed roller 11 rotates in the counterclockwise direction through drive transmitted via the corresponding gear train, but the picking roller 1 does not rotate, because the picking-roller drive gear 20 is equipped with a one-way clutch. The rotation of the feed roller 11 is transmitted to the planetary gear 5 via the corresponding gear train, so that the planetary gear 5 rotates clockwise about its own axis, and starts a counterclockwise revolving motion. Having started the revolving motion, the planetary gear 5 comes into meshing engagement with the picking-arm drive gear 8. Having come into meshing engagement with the planetary gear 5, the picking-arm drive gear 8 starts a counterclockwise pivoting motion. As a result, the picking arm 4 connected to the picking-arm drive gear 8 moves upward. The reverse rotation of the motor 6 for moving the picking arm 4 upward is continued until the picking-arm state detection sensor 7 outputs a signal indicating detection of the picking arm 4.

In the structure shown in FIGS. 4 and 5, since the motor 6 can be used for paper transport and picking arm operation, the number of components and the size of the paper feed apparatus can be decreased. Further, provision of the picking-arm state detection sensor 7 enables accurate detection of the operation position of the picking arm 4, whose motion involves varying delay, because the planetary gear frame 26 is moved by means of frictional force. Further, the paper detection sensor 12 disposed between the picking and feed rollers enables the picking arm 4 to hit the sheets of paper 21 when a sheet of paper cannot be picked, thereby improving picking performance. Further, when the sheets of paper 21 are considered to form a beam, the arm length of the beam is reduced through provision of the step 14, so that the rigidity of the sheets of paper 21 can be reduced. Therefore, even when the sheets of paper 21 curl upward, the paper pressing force exerted by the picking arm can be reliably transmitted to the picking roller 1, so that the performance for picking the sheets of paper 21 is improved.

Figure 6:
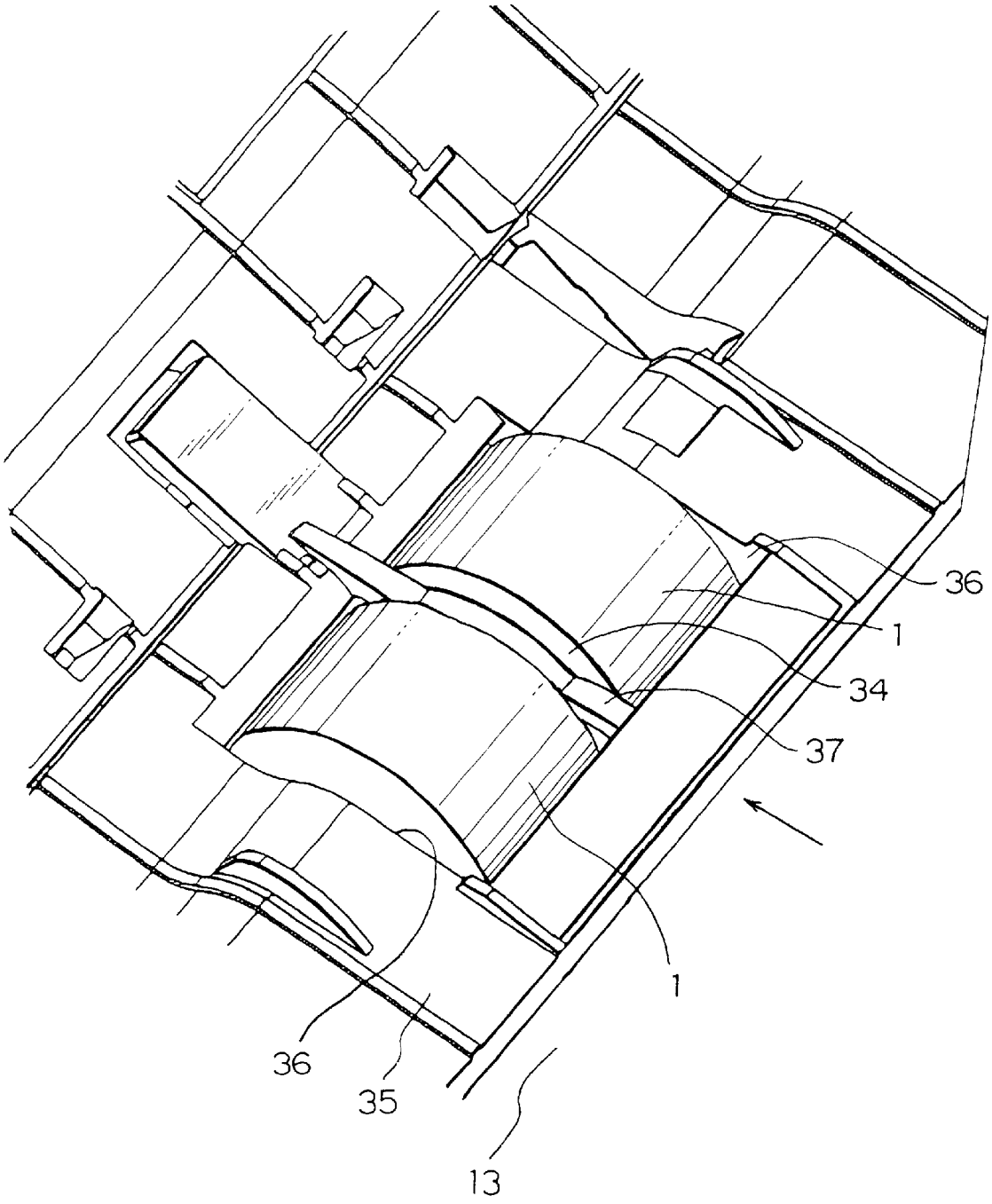
FIG. 6 is an enlarged perspective view showing a picking roller and its neighboring portions in the embodiment of the present invention.

FIG. 6 is an enlarged perspective view showing the picking roller 1 and its neighboring portions in the embodiment of the present invention. In FIG. 6, reference numeral 34 denotes a circumferential groove which is formed at an axially intermediate portion of the picking roller 1. The circumferential groove 34 may be provided at a single location, but may be formed at a plurality of locations if necessary. Reference numeral 35 denotes a paper guide disposed on the downstream side of the shooter 13 with respect to the paper transport direction and above the picking roller 1. Reference numeral 36 denotes an opening (or a roller opening) formed in the paper guide 35 and having a bridge portion 37 received in the circumferential groove 34. A portion of the outer circumference surface of the picking roller 1 is exposed to the outside through the opening 36 of the paper guide 35. An arrow in FIG. 6 indicates the paper transport direction.

The bridge portion 37 eliminates the possibility that the sheets of paper 21 being transported in the direction of the arrow become caught between the picking roller 1 and the opening 36 with a resultant paper jam. Therefore, the sheets of paper 21 can be supplied smoothly and reliably.

Figure 7:
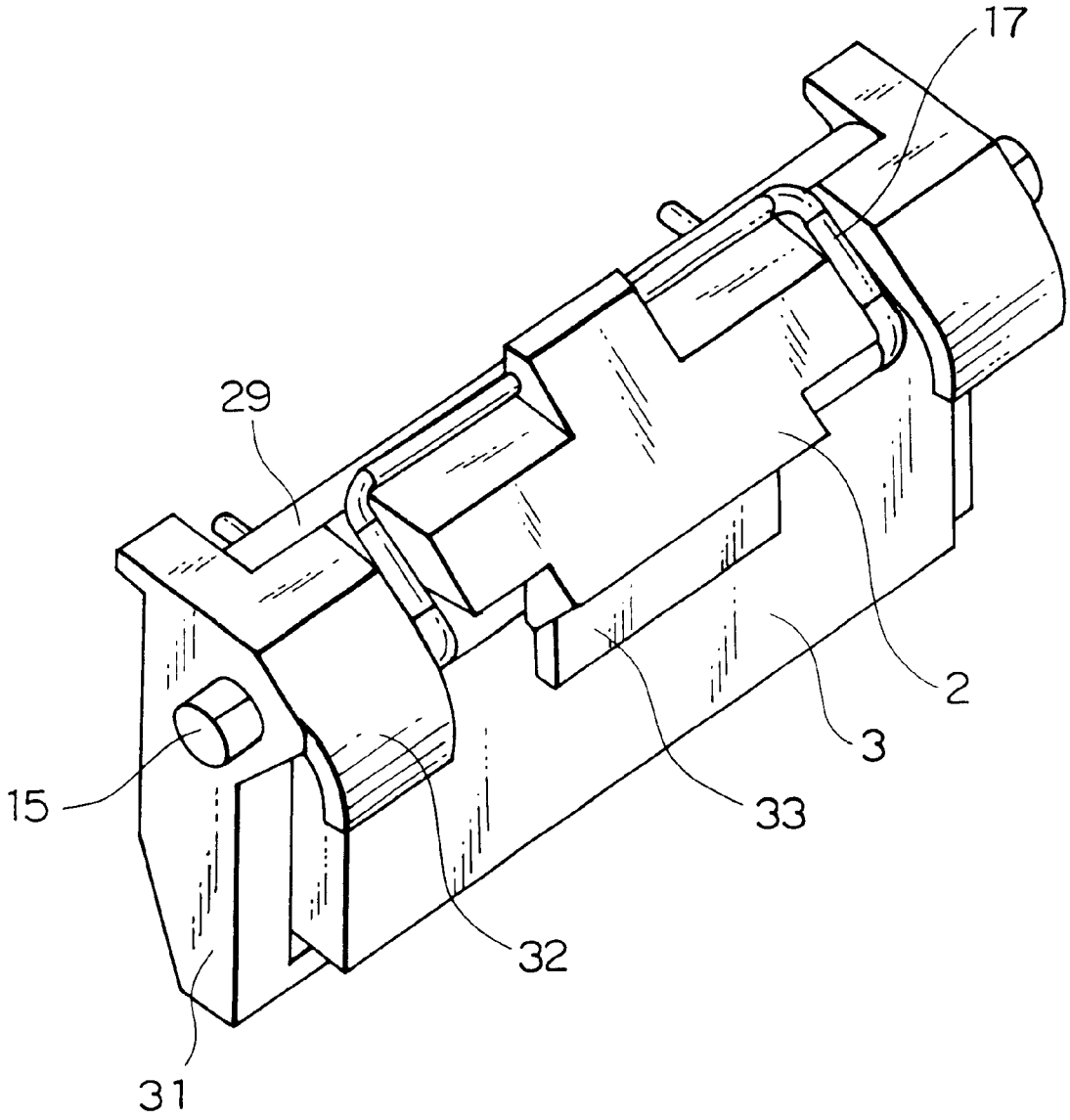
Figure 8:
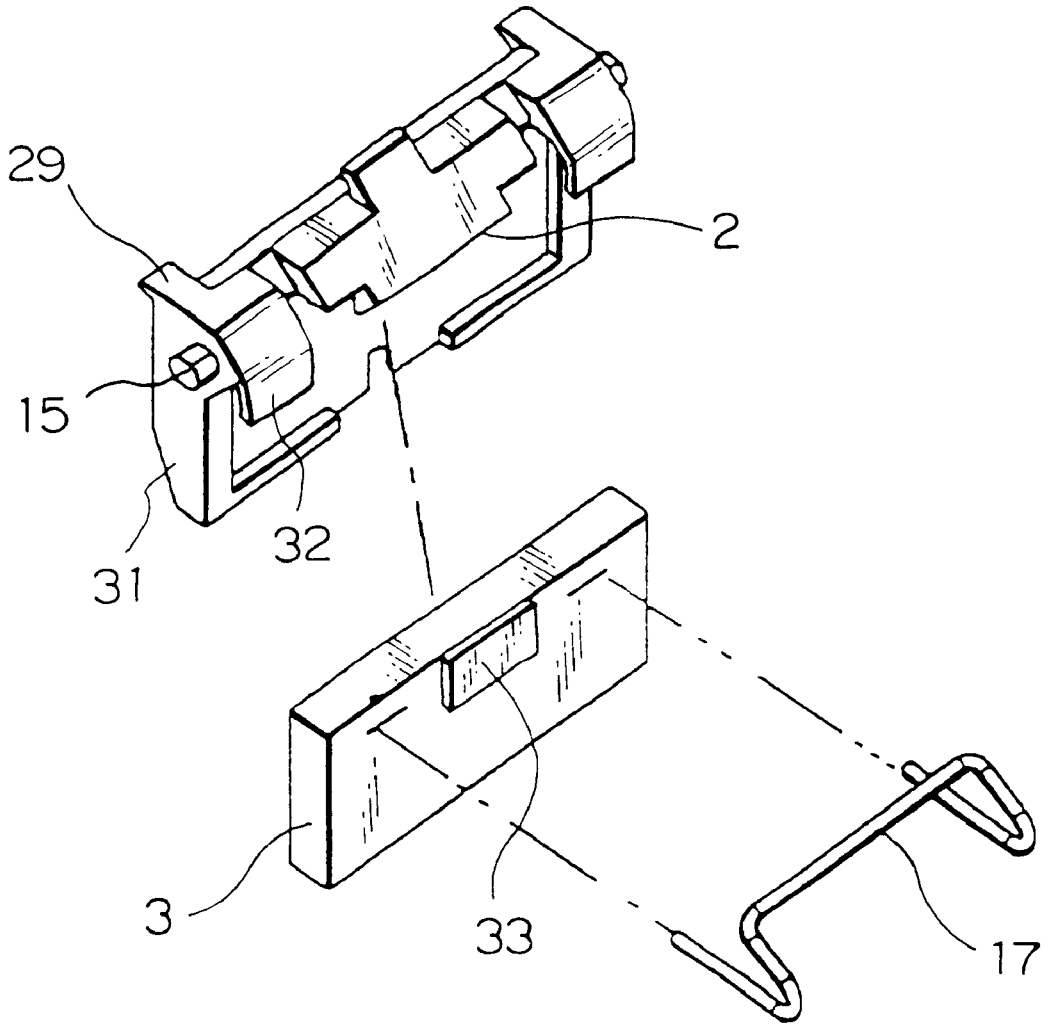
Figure 9:
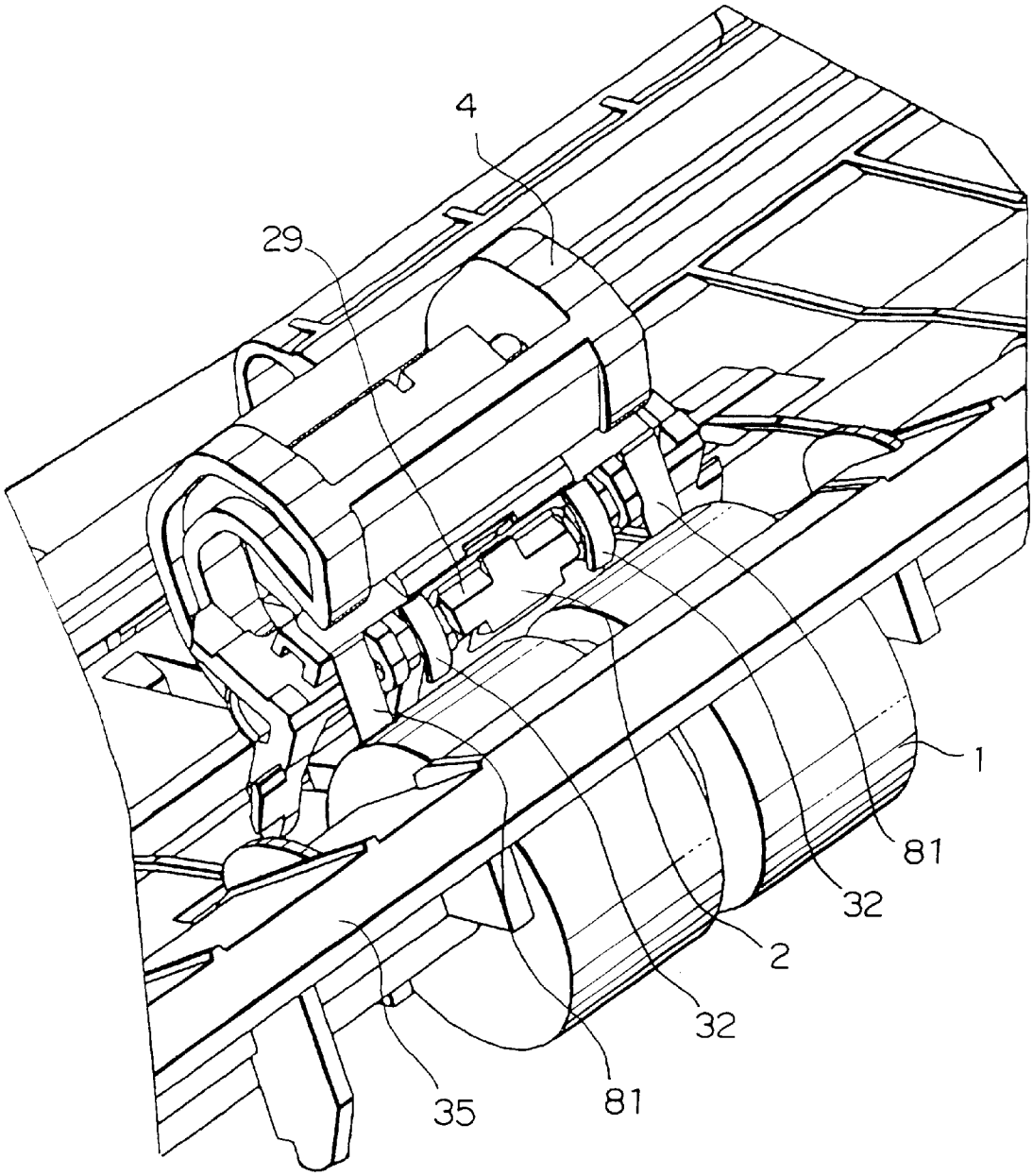
FIG. 9 is a perspective view showing a state in which the gate component shown in FIG. 7 is attached to the apparatus.

FIGS. 7 and 8 are a perspective view and an exploded perspective view, respectively, showing an integrally-molded gate component used in the embodiment of the present invention. As shown in FIGS. 7 and 8, the gate 2 and guide arms 32 are formed integrally with the holding member 31, to which the paper separation pad 3 is attached. The gate 2, the guide arms 32, and the holding member 31 constitute an integrally-molded gate component 29. A pivot shaft 15 is provided at one end of the holding member 31 carrying the gate 2 and the paper separation pad 3 such that the pivot shaft 15 is aligned with the tip end of the gate 2. A spring 16 (see FIG. 3) for producing pressure for paper separation is engaged with the other end of the holding member 31, so that the holding member 31 is urged toward the picking roller 1. FIG. 9 is a perspective view showing a state in which the gate component 29 shown in FIG. 7 is attached to the apparatus.

Since this structure minimizes the distance X between the gate 2 and the paper separation pad 3 shown in FIG. 3, the possibility of the leading end of a sheet of paper being turned up between the gate 2 and the paper separation pad 3 can be minimized. Therefore, the paper feed performance is improved, and the gate 2 and paper separation pad 3 can be reduced in size in order to reduce the overall size of the paper feed apparatus. Further, since the axis of the pivot shaft 15 is aligned with the tip end of the gate 2, a stable gate gap (clearance) can be secured without regard to variation in thickness of the paper separation pad 3 among products or friction of the paper separation pad 3 caused by paper feed.

As shown in FIGS. 7 and 8, the gate component 29 is molded to have a portion corresponding to the gate 2 and to enable attachment of the paper separation pad 3 and a pad fixation wire spring 17. The paper separation pad 3 is fixed through use of the pad fixation wire spring 17. Specifically, a horizontally extending portion of the pad fixation wire spring 17 is engaged with the upper portion of the gate 2, and the opposite ends of the pad fixation wire spring 17 are inserted into through holes formed in the paper separation pad 3 and further into unillustrated through holes formed in the holding member 31 in the vicinity of the gate 2.

Since the above structure reduces the space required for mechanical fixation, the gate 2 and the paper separation pad 3 can be reduced in size in order to reduced the overall size of the paper feed apparatus. Further, since exfoliation of the paper separation pad 3 or other problems hardly occur, paper separation can be performed stably. Since attachment of the paper separation pad 3 requires no time for drying, attachment of the paper separation pad 3 to the gate component 29 can be completed within a shorter period of time than in the case where adhesive is used.

Figure 10:
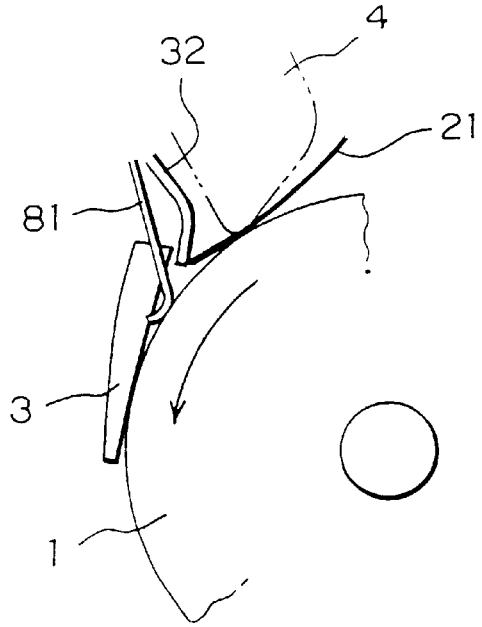
FIG. 10 is a view used for description of action of guide arms.

Next, action of the guide arms 32 will be described. FIG. 10 is a view used for description of action of the guide arms 32. As shown in FIG. 10, the leading end of a sheet of paper 21 tends to lift, because of the force applied from the picking arm 4 to the picking roller 1. Accordingly, if the guide arms 32 were not present, the sheet of paper 21 would abut the pressing arms 81 or the paper separation pad 3 at a larger abutting angle, with the result that the leading end of the sheet of paper 21 would turn up.

By contrast, in the present invention, the guide arms 32 are disposed on the upstream side of the pressing arms 81 with respect to the paper transport direction such that their tip ends are located in proximity to the picking roller 1. Therefore, the leading end of the sheet of paper 21 is pushed by the guide arms 32 toward the picking roller 1, so that the angle at which the sheet of paper 21 abuts the pressing arms 81 or the paper separation pad 3 is decreased, and thus an upturn phenomenon is prevented.

In the embodiment of the present invention, the guide arms 32 are formed integrally with the holding member 31 from the same resin material. However, the guide arms 32 may be formed from a metallic material having elasticity, such as spring material. In this case, the guide arms 32 may be integrated with the holding member 31 through so-called insert molding. Alternatively, the guide arms 32 may be formed integrally with the pressing arms 81 by use of metallic material.

Figure 11:
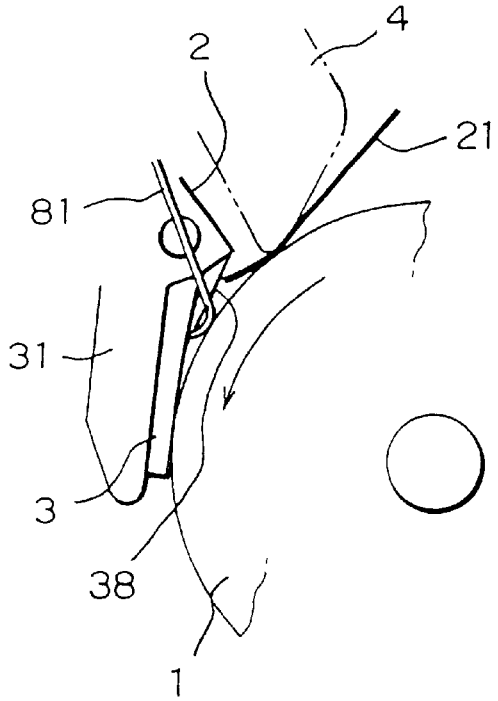
FIG. 11 is a view used for description of paper guide action in another embodiment of the present invention.

FIG. 11 is a view used for description of paper guide action in another embodiment of the present invention. In FIG. 11, reference numeral 38 denotes a guide member which is formed integrally with the holding member 31 or the gate 2 to be located on the upstream side of the pressing arms 81 or the paper separation pad 3. The surface of the guide member 38 has an inclination angle, with respect to the paper transport direction, smaller than that of the pressing arms 81 or the paper separation pad 3. The guide member 38 is formed such that the guide member 38 does not contact the picking roller 1, and the leading end of a sheet of paper 21 can abut the guide member 38 and slide therealong.

In the above-described structure, as in the case of the guide arms 32 shown in FIG. 10, the leading end of the sheet of paper 21 is guided downward by the guide member 38, so that the angle at which the sheet of paper 21 abuts the pressing arms 81 or the paper separation pad 3 is decreased, thus preventing an upturn phenomenon.

Figure 12:
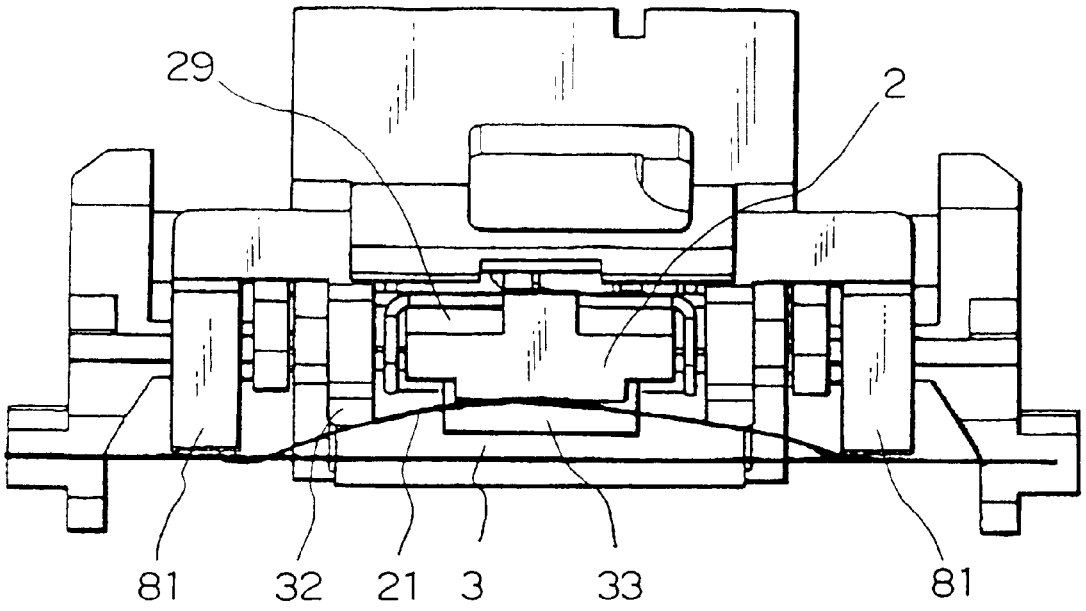
FIG. 12 is a view showing a paper supply opening and its neighboring portions in the embodiment of the present invention.
Figure 13:
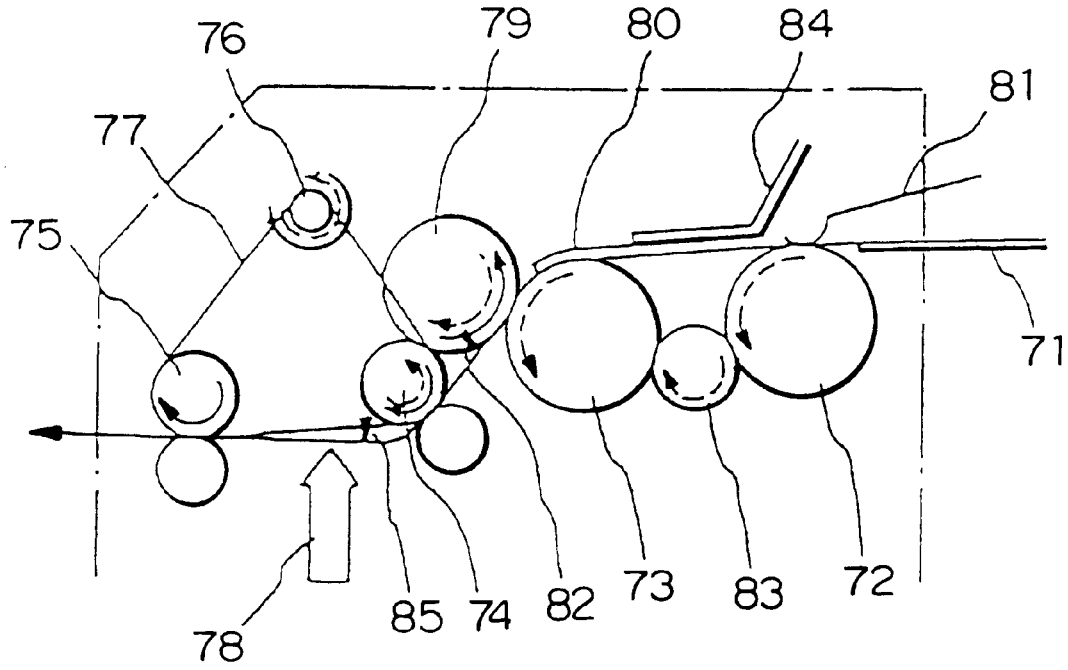
FIG. 13 is a view showing a conventional paper feed apparatus.

FIG. 12 is a view showing a paper supply opening and its neighboring portions in the embodiment of the present invention. In FIG. 12, the sheet of paper 21 is transported away from the viewer. A guide sheet 33 covering a portion of the paper separation pad 3 is formed of a material having a coefficient of friction lower than that of the material constituting the paper separation pad 3. Further, the guide sheet 33 is disposed such that the guide sheet 33 does not contact the picking roller (not shown in FIG. 12), and the leading end of a sheet of paper 21 can abut the guide sheet 33 and slide therealong.

The above-described structure provides an upturn-preventing action. That is, even when a sheet of paper 21 is supplied in a state in which the center portion thereof is lifted as shown in FIG. 12, the leading end of the sheet of paper 21 slides downward along the surface of the guide sheet 33 after abutment with the surface thereof, so that the leading end of the sheet of paper 21 does not turn up. The structure shown in FIG. 12 is particularly effective when the sheet of paper 21 is thin.

In the structure shown in FIG. 11, the guide member 38 integrated with the gate 2 also provides the above-described upturn-preventing action.

Since the paper feed apparatus according to the present invention has the above-described structure and operates as described above, the following effects are provided.

That is, since a plurality of sheets of paper stacked on the shooter are picked in succession, one sheet at a time, from the bottom of the paper stack and are transported to the paper feed path, the paper feed apparatus cam be made compact.

Since the gate extends substantially perpendicular to the paper transport direction, no component force is produced in the direction perpendicular to the sheets of paper, so that paper separation performance is improved.

Even when a large number of sheets of paper are placed on the shooter, an operation for forming the leading ends of the sheets into a knife-edge-like shape is unnecessary, thus facilitating operation.

Further, a circumferential groove is formed at an axially center portion of the picking roller; an opening is formed in the paper guide such that the opening has a bridge portion fitted into the circumferential groove; and a portion of the picking roller is exposed to the outside through the opening. Therefore, the sheets of paper can be supplied smoothly without becoming caught.

Since the guide arms are disposed on the upstream side of the pressing arms in sliding contact with the picking arm, the angle of abutment of the sheet of paper with respect to the separation pad can be decreased, so that upturn of the leading end of the sheet of paper can be prevented.

Further, since the guide sheet formed of a material having a coefficient of friction lower than that of the separation pad is disposed to cover a portion of the separation pad, the lifted leading end of the sheet of paper can be urged downward for correction, so that upturn of the leading end of the sheet of paper can be prevented.

Moreover, since the surface of the guide member disposed between the gate and the separation pad has an inclination angle, with respect to the paper transport direction, smaller than that of the surface of the separation pad, upturn of the leading end of the sheet of paper can be prevented as in the above-described case.

What is claimed is:

1. A paper feed apparatus, comprising:

a picking roller successively picking a plurality of sheets of paper stacked on a shooter from the bottom of the paper stack, transporting the sheets of paper to a standby position and having one or a plurality of circumferential grooves formed on it;

a gate extending substantially perpendicular to a paper transport direction and forming a predetermined clearance between the picking roller gate;

a separation pad disposed in sliding contact with the outer circumferential surface of the picking roller and adapted to draw in a single sheet of paper at the standby position;

a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening; and a paper guide disposed above the picking roller and having a roller opening and one or a plurality of bridge portions, the bridge portions extending across the roller opening and fitted in the circumferential grooves.

2. A paper feed apparatus according to claim 1, wherein one circumferential groove is formed in an axially center portion of the picking roller, and one bridge portion extends across the roller opening and fitted in the circumferential groove.

3. A paper feed apparatus according to claim 1, further comprising:

pressing arms formed of an elastic material and disposed in sliding contact with the picking roller; and guide arms disposed on the upstream side of the pressing arm with respect to the paper transport direction such that their tip ends are located in proximity to the picking roller.

4. A paper feed apparatus according to claim 3, wherein the guide arms are formed on the both sides of the gate and the pressing arms are formed on both sides of the guide arms.

5. A paper feed apparatus according to claim 3, wherein one circumferential groove is formed in an axially center portion of the picking roller, and one bridge portion extends across the roller opening and fitted in the circumferential groove.

6. A paper feed apparatus according to claim 5, wherein the gate and separation pad are formed so as to correspond to at least the axially center portion of the picking roller and have width wider than the circumferential groove.

7. A paper feed apparatus according to claim 6, wherein the guide arms are formed on both sides of the gate, and the pressing arms are formed on the both sides of the guide arms so as to correspond to both edges of the picking roller.

8. A paper feed apparatus according to claim 1, further comprising:

a guide sheet formed of a material having a coefficient of friction lower than that of the material constituting the separation pad, the guide sheet being disposed to cover a portion of the separation pad such that the guide sheet does not contact the picking roller, and such that the leading end of the sheet of paper can abut and slide along the guide sheet.

9. A paper feed apparatus according to claim 1, further comprising:

a guide member disposed between the gate and the separation pad with respect to the paper transport direction, a surface of the guide member having an inclination angle with respect to the paper transport direction smaller than that of a surface of the separation pad, and the guide member being provided integrally with either the gate or a holding member supporting the separation pad such that the guide member does not contact the picking roller and such that the leading end of the sheet of paper can abut and slide along the guide member.

10. A paper feed apparatus, comprising:

a picking roller successively picking a plurality of sheets of paper stacked on a shooter from the bottom of the paper stack and transporting the sheets of paper to a standby position;

a gate extending substantially perpendicular to a paper transport direction and forming a predetermined clearance between the gate and the picking roller;

a separation pad disposed in sliding contact with the outer circumferential surface of the picking roller and adapted to draw in a single sheet of paper at a time from the standby station;

a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening;

a pressing arm formed of an elastic material and disposed in sliding contact with the picking roller; and guide arms disposed on the upstream side of the pressing arm with respect to the paper transport direction such that their tip ends are located in proximity to the picking roller.

11. A paper feed apparatus according to claim 10, further comprising:

a guide sheet formed of a material having a coefficient of friction lower than that of the material constituting the separation pad, the guide sheet being disposed to cover a portion of the separation pad such that the guide sheet does not contact the picking roller, and such that the leading end of the sheet of paper can abut and slide along the guide sheet.

12. A paper feed apparatus according to claim 10, further comprising:

a guide member disposed between the gate and the separation pad with respect to the paper transport direction, a surface of the guide member having an inclination angle with respect to the paper transport direction smaller than that of a surface of the separation pad, and the guide member being provided integrally with the gate or a holding member supporting the separation pad such that the guide member does not contact the picking roller and such that the leading end of the sheet of paper can abut and slide along the guide member.

13. A paper feed apparatus, comprising:

a picking roller successively picking a plurality of sheets of paper stacked on a shooter from the bottom of the paper stack and transporting the sheets of paper to a standby position;

a gate extending substantially perpendicular to a paper transport direction and forming a predetermined clearance between the gate and the picking roller;

a separation pad disposed in sliding contact with the outer circumferential surface of the picking roller and adapted to draw in a single sheet of paper at a time from the standby station;

a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening; and a guide sheet formed of a material having a coefficient of friction lower than that of the material constituting the separation pad, the guide sheet being disposed to cover a portion of the separation pad such that the guide sheet does not contact the picking roller, and such that the leading end of the sheet of paper can abut and slide along the guide sheet.

14. A paper feed apparatus, comprising:

a picking roller successively picking a plurality of sheets of paper stacked on a shooter from the bottom of the paper stack and transporting the sheets of paper to a standby position;

a gate extending substantially perpendicular to a paper transport direction and forming a predetermined clearance between the gate and the picking roller;

a separation pad disposed in sliding contact with the outer circumferential surface of the picking roller and adapted to draw in a single sheet of paper at a time from the standby station;

a picking arm driven to move to an upper position when sheets of paper are placed on the shooter, and to a lower position when the sheets of paper are fed in order to press the sheets of paper placed on the shooter toward the outer circumferential surface of the picking roller in an area in the vicinity of a paper supply opening; and a guide member disposed between the gate and the separation pad with respect to the paper transport direction, a surface of the guide member having an inclination angle with respect to the paper transport direction smaller than that of a surface of the separation pad, and the guide member being provided integrally with the gate or a holding member supporting the separation pad such that the guide member does not contact the picking roller and such that the leading end of the sheet of paper can abut and slide along the guide member.

15. A paper feed apparatus according to claim 3, further comprising:

a guide sheet formed of a material having a coefficient of friction lower than that of the material constituting the separation pad, the guide sheet being disposed to cover a portion of the separation pad such that the guide sheet does not contact the picking roller, and such that the leading end of the sheet of paper can abut and slide along the guide sheet.

16. A paper feed apparatus according to claim 3, further comprising:

a guide member disposed between the gate and the separation pad with respect to the paper transport direction, a surface of the guide member having an inclination angle with respect to the paper transport direction smaller than that of a surface of the separation pad, and the guide member being provided integrally with the gate or a holding member supporting the separation pad such that the guide member does not contact the picking roller and such that the leading end of the sheet of paper can abut and slide along the guide member.

* * * * *

UNITED STATES PATENT AND TRADEMARK OFFICE

CERTIFICATE OF CORRECTION

PATENT NO. : 6,367,795 B1
DATED : April 9, 2002
INVENTOR(S) : Yasuhiro Matsuda et al.

It is certified that error appears in the above-identified patent and that said Letters Patent is hereby corrected as shown below:

Column 12,
Line 13, before "both", delete "the".
Line 27, before "both", delete "the".

Signed and Sealed this

Nineteenth Day of November, 2002

*Attest:*

*Attesting Officer*

JAMES E. ROGAN
*Director of the United States Patent and Trademark Office*